United States Patent [19]

Kneifel

[11] Patent Number: 4,716,396

[45] Date of Patent: Dec. 29, 1987

[54] HIGH POWER DENSITY, LOW CORONA RESISTOR

[75] Inventor: Jerome J. Kneifel, Bellwood, Nebr.

[73] Assignee: Dale Electronics, Inc., Columbus, Nebr.

[21] Appl. No.: 884,201

[22] Filed: Jul. 10, 1986

[51] Int. Cl.[4] ..... H01C 1/02

[52] U.S. Cl. ..... 338/226; 338/55

[58] Field of Search ..... 338/226, 227, 230, 237, 338/232, 238, 256–258, 333, 334, 20, 25, 53, 55; 219/538, 458, 216, 544; 29/610 R, 611, 613, 614

[56] References Cited

U.S. PATENT DOCUMENTS

| | | | |
|---|---|---|---|
| 2,680,184 | 6/1954 | Cox | 338/292 X |
| 3,349,722 | 10/1967 | Davis | 338/308 X |
| 4,037,082 | 7/1977 | Tamada et al. | 219/544 X |

*Primary Examiner*—C. L. Albritton

*Attorney, Agent, or Firm*—Zarley, McKee, Thomte, Voorhees & Sease

[57] ABSTRACT

A high power density, low corona resistor comprises a dielectric thermally conductive substrate having upper and lower surfaces and having a resistance element mounted on the upper surface thereof. The resistance element comprises a thin film of electrically conductive material. A pair of electrical leads are electrically connected to the resistance element and extend upwardly therefrom. An electrically insulative material covers the resistance element to provide physical and structural protection to the resistance element and the pair of leads. An electrically conductive sheet is operatively secured to the lower surface of the substrate and is in intimate contact therewith so as to substantially fill any microscopic indentations in the lower surface of the substrate thereby substantially eliminating voids between the lower surface of the substrate and the conductive sheet. Means are provided for securing the substrate to a heat sink surface with the metal sheet in heat conducting contact with the heat sink surface. A modified form of the invention includes the use of a water cooling plate in the place of the metallic sheet.

13 Claims, 4 Drawing Figures

HIGH POWER DENSITY, LOW CORONA RESISTOR

BACKGROUND OF THE INVENTION

This invention relates to a high power density, low corona resistor.

High power density, low corona resistors presently are constructed by using a cylindrical ceramic core having a wire wound resistor thereon. The wire wound resistor is mounted within a cylindrical bore of a metal housing and is molded within the bore. The heat dissipated by the resistor radiates radially outwardly through the molding material into the metal housing and is carried away.

In order for such a resistor to properly dissipate the heat resulting from high power dissipation, it is necessary that there be a minimizing of the phenomenon known as "corona". Corona results from flaws, voids or other irregularities in the dielectric compound which surrounds the wire wound resistor. Any such flaws, voids, or other irregularities cause a change in the dielectric characteristics of the dielectric compound. This variance in dielectric characteristics results in an electrical charge being ionized within the cavity, and this ionization causes a breakdown of the dielectric material.

In addition to the corona phenomena, thermal "hot spots" may sometimes develop across voids. Therefore, avoidance of voids, flaws, or other irregularities in the path of thermal conductivity is important to the proper functioning of a high power density resistor.

Therefore, a primary object of the present invention is the provision of an improved high power density, low corona resistor.

A further object of the present invention is the provision of a resistor which will exhibit a low corona level even when the resistor is subjected to a high level of voltage.

A further object of the present invention is the provision of a resistor which minimizes thermal hot spots being created across voids, flaws or irregularities in the path of heat dissipation.

A further object of the present invention is the provision of an electrical resistor which has high dielectric strength and substantial physical strength so as to minimize breakdown or inconsistent performance of the resistor.

A further object of the present invention is the provision of a resistor which permits high power dissipation relative to the size density of the resistor.

A further object of the present invention is the provision of a high power density, low corona resistor which has a low profile design.

A further object of the present invention is the provision of a high power density, low corona resistor which may be mounted in various directions within the electrical component in which it is used.

A further object of the present invention is the provision of a high power density, low corona resistor which maintains a low thermal dissipation to the air surrounding the resistor and which maximizes the thermal dissipation through a heat sink to which the resistor is mounted.

A further object of the present invention is the provision of a high power density, low corona resistor which is economical to manufacture, durable in use and efficient in operation.

SUMMARY OF THE INVENTION

The present invention comprises a relatively thin substrate having a thickness of between 0.040 and 0.060 inches. On the upper surface of the substrate is mounted an electrically conductive sheet which functions as a resistance element. The sheet may be printed or deposited on the upper surface of the substrate or it may be a thin foil which is secured to the substrate by adhesive or other means. A pair of contact pads are also mounted on the upper surface of the substrate and are in electrical connection with the resistance element. A pair of leads each have a lower end connected to one of the contact pads and an upper end extending upwardly from the substrate. Alternatively, multiple resistance elements may be printed or otherwise deposited on the substrate with multiple contact pads and leads connected thereto.

A housing is mounted over the substrate and includes a pair of lead openings through which the leads may extend. The leads have connection means on their upper ends which are outside the housing, and which are on the upper surface of the housing.

A dielectric molding or potting material is provided within the housing and covers the lower ends of the leads, the lead connections, and the resistance element so as to provide physical protection thereto. The dielectric material may be a molding compound, a potted material or a dielectric paint which is provided over the resistance element and the lower ends of the leads.

Mounted to the lower surface of the substrate is a thin conductive sheet which is in intimate contact with the lower surface of the substrate. The substrate is preferably comprised of a ceramic material which is a dielectric material but which also is a good heat conductor. Examples are alumina or beryllium oxide. The lower surface of the substrate often has a plurality of microscopic indentations or imperfections therein. The conductive sheet material is in intimate contact with the lower surface of the substrate and substantially fills the microscopic indentations which are in the lower surface of the substrate. This is important so as to eliminate or minimize any voids in the interface between the conductive sheet and the lower surface of the substrate.

The conductive sheet is preferably a conductive paint containing fillers which are carbon or perhaps silver. An example of a preferred conductive paint is manufactured by Acheson Colloids of Port Huron, Mich. under the model designation Aerodag G.

A pair of screws or bolts extend downwardly through the housing, the substrate, and the conductive sheet on the lower surface of the substrate. The lower ends of the bolts may be attached to a chassis for securing the resistor to the chassis with the conductive sheet in intimate contact with the chassis so as to maximize the heat conduction from the conductive sheet to the chassis.

An alternate form of the invention includes the use of a water cooling plate in lieu of the conductive plate on the lower surface of the substrate. The water cooling plate includes water passageways for permitting the circulation of water therethrough to provide further cooling of the plate so that heat dissipation can be maximized.

To obtain maximum benefits of this resistor from high wattage dissipation, it is sometimes desirable to have a cooled chassis. This can be done by circulating water through the chassis or by utilizing a refrigeration system, circulating air, or other cooling fluids to cool the chassis. Circulating water is the most practical.

DETAILED DESCRIPTION OF THE PREFERRED EMBODIMENT

Figure 1:
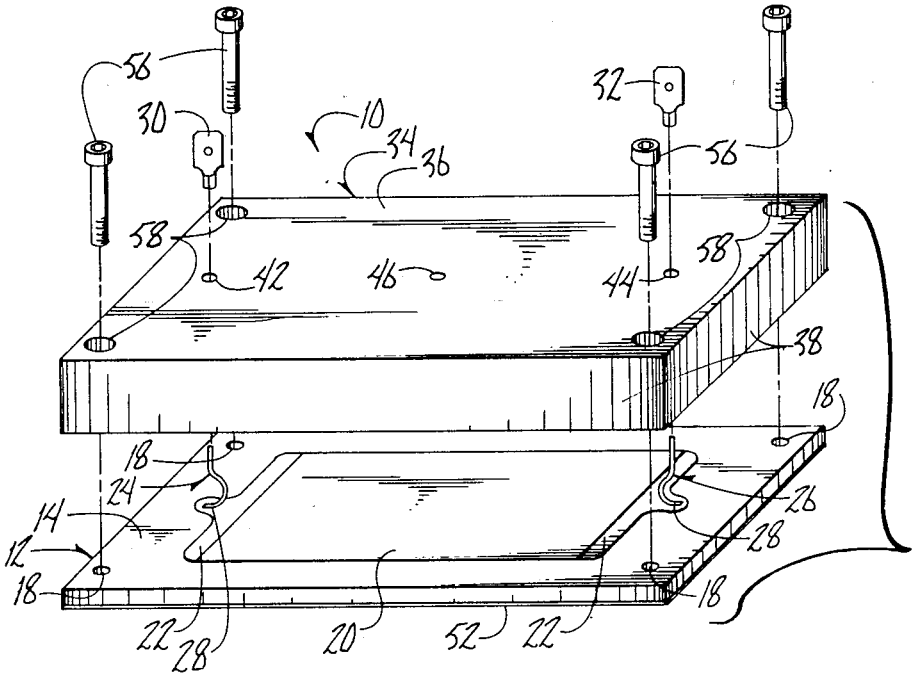
FIG. 1 is an exploded perspective view of the present invention.
Figure 2:
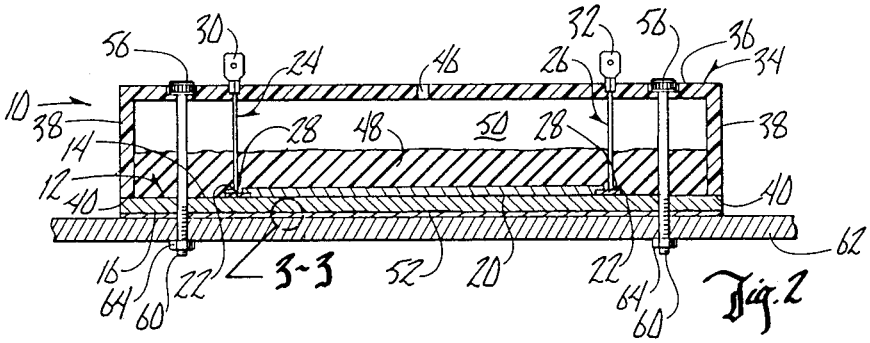
FIG. 2 is a sectional view of the resistor of the present invention.

Referring to the drawings, the numeral 10 generally designates the high power density, low corona resistor of the present invention. Resistor 10 includes a substrate 12 which is substantially rectangular in shape and which includes an upper surface 14 and a lower surface 16 (FIG. 2). Lower surface 16 and upper surface 14 are approximately parallel to one another, and the vertical thickness of substrate 12 is preferably between 0.040 and 0.060 inches. Substrate 12 should be constructed of a thermally conductive dielectric material such as alumina or berrylium oxide. As the thickness of the substrate increases, the device becomes less efficient, and as the thinness decreases, it becomes more efficient down to a thickness of approximately 0.040, at which point any further decrease in thickness may result in a breakdown of the substrate during operation of the resistor. The four corners of the substrate 12 are provided with bolt receiving holes 18.

Mounted on the upper surface 14 of substrate 12 is a sheet-like resistance element 20. Resistant element 20 may be formed from a resistive material which is printed or otherwise deposited on the substrate. It also may be a foil which is adhered to the upper surface of substrate 12 by a suitable adhesive.

Also deposited on the substrate are a pair of contact pads 22 which are electrical conductors and which are in electrical contact with the ends of resistance element 20. Contact pads 22 may be printed under the ends of resistance element 22 as shown, or they may be printed over resistance element 22.

A pair of electrical leads 24, 26 each include a lower end 28 which is electrically connected to one of contact pads 22 by soldering, welding or the like. Leads 24, 26 also include upper ends which are attached to a pair of electrical connectors 30, 32.

Mounted over substrate 12 is a dielectric plastic housing 34 which includes a top wall 36 and a plurality of side walls 38 which terminate in lower edges 40 and which abut against the upper surface 14 of substrate 12. Top wall 36 of housing 34 includes a pair of lead holes 42, 44 which are adapted to receive the upper ends of leads 24 and which are also adapted to receive electrical connectors 30 which are operatively secured therein.

A fill hole 46 is provided in top wall 36 and is used to introduce a potting compound or molding compound 48 within the cavity 50 formed by housing 34. As can be seen in FIG. 2, compound 48 preferably fills the bottom third of cavity 50, but it is also possible for the potting compound 48 to fill more or less space within cavity 50 than shown in FIG. 2. For example, the compound 50 may be a layer of dielectric paint which covers the resistance element 20, the contact pads 22 and the lower ends 28 of leads 24, 26. Another variation could be the complete filling of cavity 50 with the potting compound 48.

A conductive sheet 52 is secured to the lower surface 16 of substrate 12 and completely covers the lower surface 16. It is important to the present invention that sheet 52 be in intimate contact with the lower surface 16 of substrate 12 because any voids in the interface between sheet 52 and lower surface 16 will result in the corona phenomena during operation of the resistor. These voids will provide a different dielectric constant than the dielectric constant of the substrate 12, and this results in ionization of the air within the voids to cause a breakdown of the dielectric material. Voids can also result in thermal hot spots being created across the void and these hot spots may interfere with the consistency of the performance of the resistor element 20 during operation.

Therefore, an intimate contact of the conductive plate 52 with the lower surface of substrate 12 is important to the present invention. This intimate contact can be accomplished by using a conductive paint to form the conductive sheet 52. The conductive paint preferably will include fillers such as carbon or silver which enhance the electrical conductive and the thermal conductive properties of the metallic layer.

Figure 3:
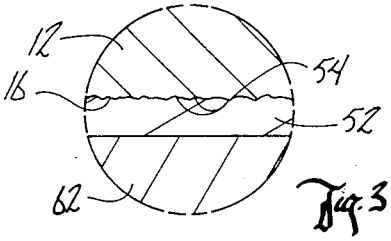
FIG. 3 is an enlarged detailed sectional view taken along line 3—3 of FIG. 2.

It is also important that layer 52 be an electrically conductive material. The reason for this is illustrated in FIG. 3 of the drawings which is an enlarged partial sectional view taken along line 3—3 of FIG. 2. The under surface 16 of substrate 12, when viewed under a microcrope, has a plurality of indentations designated by the numeral 54 in FIG. 3. The conductive layer 52 preferably fills these indentations so as to eliminate any voids in the interface between lower surface 16 and conductive layer 52. If layer 52 is formed from a dielectric material, this dielectric material will fill the indentations 16, and may result in the indentations 16 being filled with a material having a different dielectric constant than the dielectric constant of the ceramic material within substrate 12.

These two materials of different dielectric constants can result in the corona phenomena much in the same fashion as occurs if the indentations include voids. The use of a conductive layer prevents this variation in dielectric constants, and minimizes the likelihood of corona and the consequent instability or breakdown in the resistor. Therefore, the use of a conductive material for layer 52 as well as the intimate contact of layer 52 with the undersurface 16 of substrate 12 are important features of the present invention.

Four screws or bolts 56 extend downwardly through bolt holes 58 in housing 34, and also through bolt holes 18 in substrate 12. Bolts 56 hold housing 34 in tight securement over substrate 12. Also, bolts 56 include lower ends 60 which protrude below conductive layer 52 and which are adapted to fit through mounting holes in a chassis 62 for mounting of the resistor 10 to chassis 62. Four nuts 64 are threaded on the lower end 60 of bolts 56 for securing the resistor to chassis 62.

Figure 4:
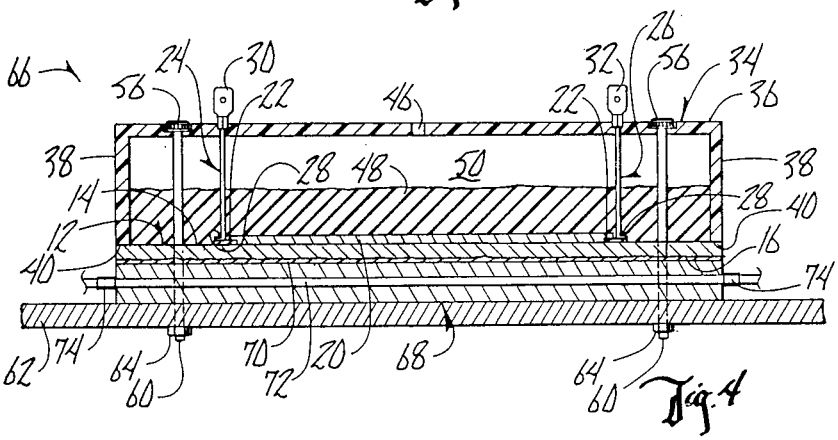
FIG. 4 is a sectional view similar to FIG. 2, but showing a modified form of the invention.

Referring to FIG. 4, a modified form of the invention is shown and is designated by the numeral 66. The upper portions of the resistor 66 are identical to the resistor 10 shown in FIG. 2, and therefore corresponding numerals indicate identical parts. The primary difference between resistor 66 and resistor 10 shown in FIG. 2 is that resistor 66 includes a cooling plate 68 in the place of metallic sheet 52. Cooling plate 68 is attached to the lower surface 16 of substrate 12 by means of an adhesive 70 which holds the cooling plate 16 in intimate contact with substrate 12. Extending through cooling plate 68 are a plurality of water passageways 72 which include connectors 74 at their opposite ends for connecting the passageways 72 to a source of cooling fluid such as water. The cooling fluid passing through passageways 72 provides further ability of the device to carry heat away from the resistance element 20 during operation of the resistor.

To obtain maximum benefits of the resistor from high wattage dissipation, it is sometimes desirable to have a cooled chassis. This can be done by circulating water through the chassis or by utilizing a refrigeration system, circulating air, or other cooling fluids to cool the chassis. Circulating water is the most practical. This can be accomplished by placing passagways 72 and connectors 74 within the chassis 62 rather than in cooling plate 68.

The present invention results in a resistor that has a high dielectric strength, excellent power dissipation relative to size density, extremely low corona generation with a small amount of heat dissipation into the surrounding air. The dissipation of the heat is conducted primarily through substrate 12, metallic layer 52 (or cooling plate 68), and chassis 62. This minimizes a heating of the air which surrounds the resistor.

The housing 34 and the potting compound 48 provide strong physical reinforcement to the resistance element 20 and to the connection of leads 24, 26 to the contact pads 22.

The fact that the electrical connectors 30, 32 are mounted at the upper surface of the housing 34 permits the housing 34 to be positioned within an electrical circuit in a variety of positions, while still maintaining flexibility in the manner in which the leads 30, 32 may be connected to other components in the circuitry. In prior devices, the two leads extended axially from the ends of the resistor, and therefore there was less flexibility in the manner in which the resistor could be positioned in the circuitry.

The present invention also provides a low profile device which is rectangular in shape and which has a vertical thickness substantially less than the metal housed high power resistors presently known in the art.

The preferred materials for the various components are as follows:

Metallic sheet 52 is a conductive paint spray containing either carbon or silver fillers. An example of such a compound is manufactured by Acheson Colloids Co. of Port Huron, Mich. under the model designation Aerodag G.

The resistance element 20 may be a printed conductive sheet or it can be a foil which is glued onto the ceramic.

The compound 48 may be a dielectric paint, or it can be a conventional potting compound which is filled by gravity through opening 46. The compound must be sound environmentally, and must have a temperature resistance which will tolerate temperatures at least as high as 200° C. It should also be a good dielectric. An example of such a material is sold under the model designation Sylgard 567 by Dow Corning of Midland, Mich.

Thus, it can be seen that the device accomplishes at least all of its stated objectives.

What is claimed is:

1. A high power density, low corona resister adapted to be mounted on a heat sink surface, said resister comprising:

a housing member having a top wall and a plurality of side walls forming a cavity within said housing, said side walls having bottom edges defining a bottom opening in said housing;

a dielectric thermally conductive substrate having an upper surface and a lower surface, at least a portion of said upper surface being positioned in covering relation over said bottom opening of said housing, said lower surface being substantially planar and having a plurality of microscopic indentations therein;

a resistance element mounted upon said upper surface of said substrate, said resistance element comprising a single thin film of electrically conductive material in intimate contact with said upper surface of said substrate;

a first lead means and a second lead means each having first and second ends, both of said first ends being above said upper surface of said substrate and being electrically connected to said resistance element;

an electrically insulative material covering said resistance element and said first ends of said pair of leads to provide physical, environmental and structural protection to said resistance element and said first ends of said pair of lead means, said second ends of said leads protruding outside said insulative material and upwardly therefrom and extending through and outside said housing member;

an electrically conductive sheet operatively secured to said lower surface of said substrate and being in intimate contact with said lower surface of said substrate so as to substantially fill said microscopic indentations therein and substantially eliminate voids capable of causing corona phenomena between said lower surface and said conductive sheet; and said substrate being the only dielectric material between said resistance element and said electrically conductive sheet so as to eliminate dielectric materials of more than one dielectric constant therebetween and thereby minimizing corona phenomena between said resistance element and said conductive sheet;

securing means securing said housing member to said substrate and being adapted to attach said housing member and said substrate to said heat sink surface with said conductive sheet in heat conducting contact with said heat sink surface.

2. A resistor according to claim 1 wherein said housing includes a pair of lead holes therein, said second ends of said first and second lead means extending through said pair of lead holes to the exterior of said housing, said first ends of said lead means being within said housing cavity, said lead means being completely above said substrate.

3. A resistor according to claim 2 wherein said housing includes a fill hole therein for permitting the introduction of said insulative material to said cavity after said housing has been secured by said securing means to said substrate.

4. A resistor according to claim 3 wherein said insulative material comprises an insulative molding material at least partially filling said cavity.

5. A resistor according to claim 1 wherein said resistance element is applied to said upper surface of said substrate by printing.

6. A resistor according to claim 1 wherein said resistance element comprises a metal foil, an adhesive material attaching said metal foil to said upper surface of said substrate.

7. A resistor according to claim 1 wherein said upper and lower surfaces are approximately parallel to one another and said substrate has a vertical thickness of between 0.040 and 0.060 inches.

8. A resistor according to claim 1 wherein said substrate is made of an electrically insulative and heat conductive material selected from the group consisting of alumina and berrylium oxide.

9. A resistor according to claim 1 wherein said conductive sheet comprises an electrically conductive paint applied to said lower surface of said substrate.

10. A resistor according to claim 9 wherein said conductive paint includes an electrically conductive filler selected from the group consisting essentially of carbon and silver.

11. A resistor according to claim 1 wherein said conductive sheet comprises a metallic paint.

12. A high power density, low corona resistor adapted to be mounted on a heat sink surface, said resistor comprising:

a dielectric thermally conductive substrate having an upper surface and a lower surface, said lower surface being substantially planar and having a plurality of microscopic indentations therein;

a resistance element mounted upon said upper surface of said substrate, said resistance element comprising a thin film of electrically conductive material in intimate contact with said upper surface of said substrate;

a spaced apart pair of electrical lead means each having first and second ends, said first ends being electrically connected to said resistance element;

an electrically insulative material covering said resistance element and said first ends of said pair of leads to provide physical and structural protection to said resistance element and said first ends of said pair of lead means, said second ends of said leads protruding outside said insulative material;

an electrically conductive plate having upper and lower surfaces;

said electrically conductive plate being operatively secured to said lower surface of said substrate with said upper surface of electrically conductive plate being in intimate heat conductive contact with said lower surface of said substrate, said electrically conductive plate including a plurality of cooling passageways extending therethrough and means for providing fluid connection to a source of cooling fluid.

13. A resistor according to claim 12 wherein said attachment means comprises an adhesive.

* * * * *